United States Patent [19]

Lamarche

[11] 4,157,524

[45] Jun. 5, 1979

[54] MINIATURE CIRCUIT BREAKER

[75] Inventor: André G. Lamarche, Macon, France

[73] Assignee: Stopcircuit Société Anonyme, Macon, France

[21] Appl. No.: 829,935

[22] Filed: Sep. 1, 1977

[30] Foreign Application Priority Data

Mar. 25, 1977 [FR] France ..... 77 10149

[51] Int. Cl.[2] ..... H01H 71/16

[52] U.S. Cl. ..... 337/68; 337/64

[58] Field of Search ..... 337/62, 64, 68, 63, 337/66

[56] References Cited

U.S. PATENT DOCUMENTS

| | | | |
|---|---|---|---|
| 2,487,422 | 11/1949 | Carle | 337/68 |
| 3,193,647 | 7/1965 | Beaudoin et al. | 337/68 X |
| 3,422,384 | 1/1969 | Filchak et al. | 337/68 X |
| 3,710,294 | 1/1973 | Dries | 337/68 X |

FOREIGN PATENT DOCUMENTS

| | | | |
|---|---|---|---|
| 1072718 | 1/1970 | Fed. Rep. of Germany | 337/68 |
| 1424520 | 12/1965 | France | 337/68 |
| 68038 | 5/1951 | Netherlands | 337/68 |

*Primary Examiner*—George Harris

*Attorney, Agent, or Firm*—Karl F. Ross

[57] ABSTRACT

A miniature circuit breaker comprises a housing having a bimetallic element forming a movable contact and connected to one terminal of the circuit breaker and a fixed contact juxtaposed with the movable contact. A slide carries a conductive element adapted to interconnect the two contacts and is shiftable between a position in which an insulating tongue of the slide is interposed between the contacts and a position in which the conductor no longer electrically interconnects the two. A spring biases the slide into the first-mentioned position upon displacement of the bi-metallic element as a result of a current overload.

14 Claims, 11 Drawing Figures

FIG. 1
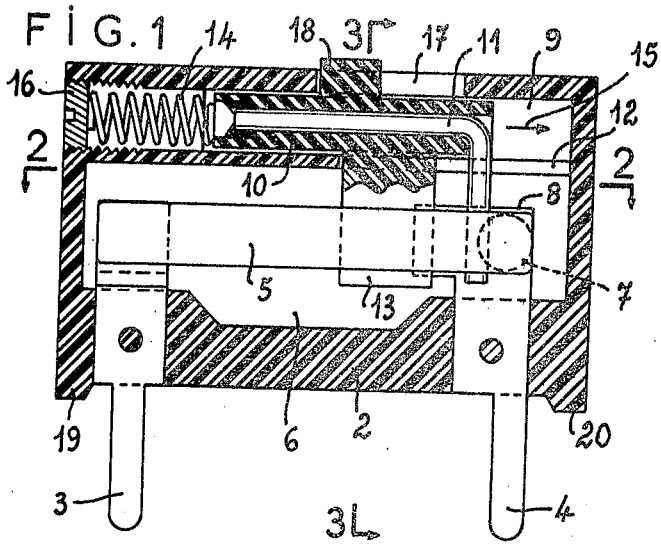
FIG. 3
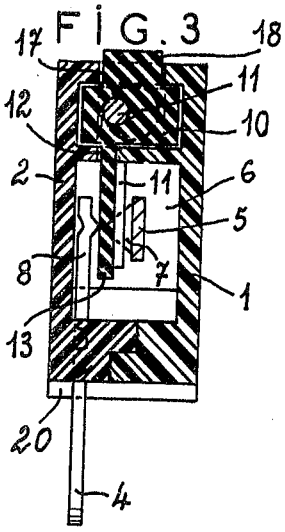
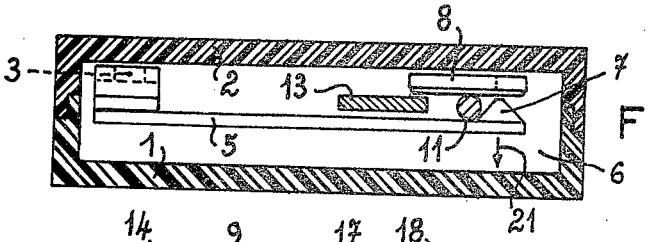
FIG. 2
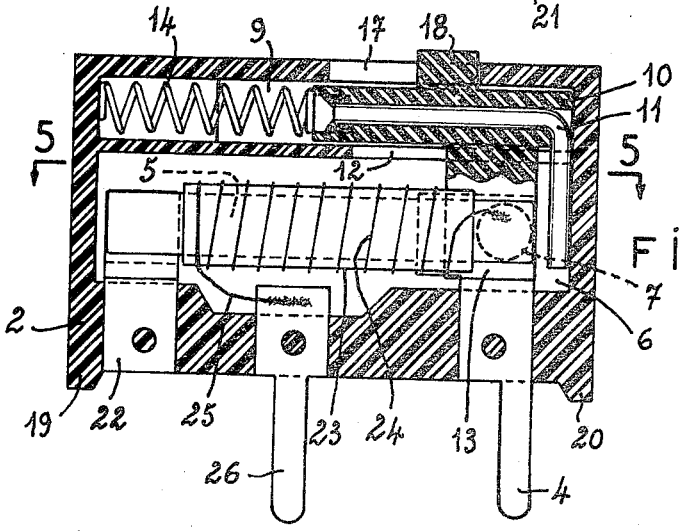
FIG. 4
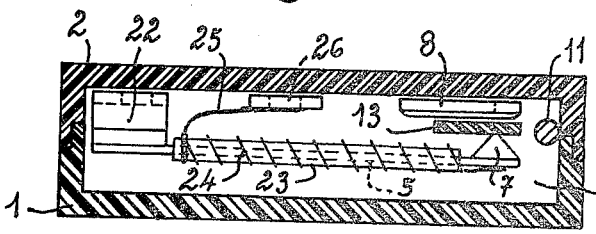
FIG. 5

MINIATURE CIRCUIT BREAKER

FIELD OF THE INVENTION

The present invention relates to a miniature circuit breaker and, more particularly, to a circuit breaker of the type in which a bimetallic element responds to a current overload and is designed to open-circuit the circuit breaker.

BACKGROUND OF THE INVENTION

A circuit breaker of the type which utilizes a bimetallic element to open-circuit the device upon detection of an overload generally comprises a fixed contact and a movable contact which are normally closed to complete an electric circuit and a bimetallic element which opens the contacts upon heating in response to an excessive current flow. The device generally comprises means which, after detection of an excessive current flow, maintains the movable contact out of engagement with the fixed contact to prevent undesired closure of the circuit after cooling of the bimetallic element.

In conventional constructions of this type one of the contacts, for example the fixed contact, is generally carried by the bimetallic element while the other contact is carried by a movable member normally retained in a position in which the contacts are closed by the bimetallic element against an elastic force, e.g. the force of a spring.

The deflection of the bimetallic element, as a result of heating by the passage of an excessive current amplitude through an electric circuit, frees the member carrying the movable contact which is thus displaced, by the elastic force, into another position in which the two contacts are spaced apart and the circuit is maintained in an open state until the movable member is manually reset into its original position.

Such constructions, in which the movable contact is carried by a member of the type described above, make it necessary to provide an electrical connection of flexible character, between the movable contact and one of the terminals of the circuit breaker. This is generally disadvantageous when extreme miniaturization of the unit is desired.

OBJECT OF THE INVENTION

It is the principal object of the present invention to provide a miniature circuit breaker which obviates the disadvantages of earlier circuit breakers using bimetallic elements, and which is of low cost, high reliability, and resistant to failure or breakdown.

SUMMARY OF THE INVENTION

This object and others which will become apparent hereinafter are attained, in accordance with the present invention, in a miniature circuit breaker which comprises a support or housing provided with a fixed contact, and a movable member displaceable between two positions corresponding, respectively, to closure and opening of the electric circuit, i.e. closure of an electric circuit between the contacts and opening thereof. The movable member of the present invention is biased by a spring tending to displace the movable member into an open circuit position, the movable member carrying a conductive element and an insulating element.

The conductive element is adapted to be disposed between the fixed contact and the movable contact to form an intermediate conductive path between the two contacts in the closed-position of the member and retains the member in its normal position against the elastic force of the spring. The insulating element is positioned so as to be interposed between the fixed contact and the movable contact in the tripped position of the circuit breaker, i.e. upon deflection of the bimetallic element to release the conductor as a result of the heating of the bimetallic element upon the passage of an excessive electric current through the circuit breaker. In other words, the freeing of the conductive element by deflection of the movable contact permits the movable member to be displaced by the spring from its first normal closed-circuit position to its second or open-circuit position.

The provision of an intermediate contact, carried by a movable member, in association with a fixed contact and a movable contact carried by the bimetallic element, makes it unnecessary to provide any flexible electric conductor between one of the the contacts and one of the terminals of the device and thereby simplifies the construction of the circuit breaker and facilitates its miniaturization while assuring reliable functioning and effective circuit-breaker operation. More particularly, the insertion of an insulating element between the fixed contact and the movable contact, after tripping, eliminates all possibility of undesired closure of the circuit without re-setting.

Advantageously, the movable contact carried by the bimetallic element has a triangular profile, with two inclined ramps in opposite directions. This configuration permits a circular-cross-section conductor carried by the movable member and biased by the elastic force of the spring to act as a detent preventing spreading of the contacts in the absence of deflection of the bimetallic element but permitting displacement of the movable member upon deflection of the bimetallic element and relative camming of the two contacts apart upon resetting of the movable member.

According to a preferred embodiment of the invention, the movable member carries the conductive element and the insulating element and is constituted by a slide mounted in a guide substantially parallel to the elongated bimetallic element. The spring biassing the movable member from the closed-circuit position to the open-circuit position can be a simple helical compression spring which may be disposed within the track and which can bear upon the housing for support and against the movable member or slide.

The conductive element and the insulating element of the slide can have a projection accessible from the exterior of the housing of the circuit breaker permitting the manual displacement of the slide from its second position to its first position for resetting the circuit breaker.

The circuit breaker can have various constructions with respect to the heating of the bimetallic element and permits of either direct heating or indirect heating thereof. In the first case, the fixed contact on the one hand and the bimetallic element on the other hand, are connected to respective terminals of the circuit breaker and these terminals are connected directly in the circuit to be protected so that the bimetallic element is traversed by the electric current of the latter. In this case, the bimetallic element is heated directly by resistance-heating and opens when the current traversing the bimetallic element exceeds the rating of the circuit breaker.

In the second case, the fixed contact is connected to one terminal, while the bimetallic element is surrounded by a conductive wire constituting a resistance heating element, one end of which is connected to another terminal of the circuit breaker while the opposite end of the wire is connected to the end of the bimetallic element carrying the movable contact. Thus the electric current of the circuit to be protected passes through the resistance wire and indirectly heats the bimetallic element to cause deflection thereof and operation of the circuit breaker.

BRIEF DESCRIPTION OF THE DRAWING

The above and other objects, features and advantages of the present invention will become more readily apparent from the following description, reference being made to the accompanying drawing in which:

FIG. 1 is a cross-sectional view, taken in elevation, of a first embodiment of the invention showing the circuit breaker thereof with a directly heated bimetallic element in the position of the circuit breaker corresponding to a closed circuit;

FIG. 2 is a cross-sectional view taken along the line 2—2 of FIG. 1;

FIG. 3 is a sectional view taken along the line 3—3 of FIG. 1;

FIG. 4 is an elevational view in vertical section through a second embodiment of the invention using an indirectly heated bimetallic element in the tripped position of the circuit breaker;

FIG. 5 is a sectional view taken along the line 5—5 of FIG. 4;

SPECIFIC DESCRIPTION

Figure 6:
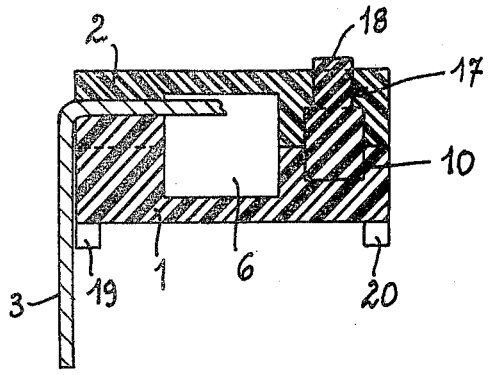
FIG. 6 is a transverse cross-sectional view, simplified in that certain parts illustrated in other FIGS. have not been shown, of still another embodiment of a circuit breaker according to the invention.

The circuit breaker shown in FIGS. 1 through 3 constitutes a first embodiment of the invention and comprises a housing of synthetic resin material constituted by a front half 1 and a rear half 2 and provided with two brass connecting terminals 3 and 4 in the form of plug or solder plugs.

The first terminal 3 carries, within the housing, a bimetallic element 5 which is elongated and disposed in the interior of the cavity 6 formed between the housing halves 1 and 2.

At its free end, the bimetallic element 5 carries a movable contact 7 having a triangular profile with two inclined ramps of opposite direction as shown in FIG. 2. This movable contact 7 is preferably constituted by a small silver block of conical configuration.

The second terminal 4 is extended, in the interior of the cavity 6 of the housing, by a conductive member 8 juxtaposed with the movable contact 7 and constituting the fixed contact of the circuit breaker.

In the upper part of the housing defined between the two housing halves 1 and 2, there is provided a track 9 of rectangular cross-section substantially parallel to the bimetallic element 5 and within which is shiftable a slider 10 constituting a movable member and composed of a plastic (synthetic resin) insulating material.

The slider 10 carries a conductive element 11, for example of silver, in the form of a wire bent at right angles and having a circular cross-section.

One branch of this bent wire is fixed in a socket longitudinally formed in the slider 10. The other branch is turned toward the bottom and extends into the cavity 6 through a window 12 communicating between this cavity and the track 9 in the region of the contacts 7 and 8.

The slider 10 is itself unitarily formed with a projection reaching toward the bottom and constituting an insulating element 13 in the form of a tongue which projects into the cavity 6 through the window 12.

A helicoidal spring 14, lodged within the track 9 under precompression, is seated on the one end against the housing and on the other end bears upon the slider 10 so as to urge the latter in the direction of arrow 15. The spring 14, at its end bearing against the housing, can be seated against a plug 16 which is threaded into the housing and can serve to adjust the precompression of the spring and block the end of the track.

The upper face of the housing is provided with a longitudinal slot 17 traversed by a further projection 18 rigid with the slider 10 and manually engageable to permit resetting the circuit breaker.

The circuit breaker of FIGS. 1 through 3 can be mounted upon a printed circuit (not shown) with the housing resting upon the surface of this printed circuit board by the feet 19 and 20 formed on the bottom of the circuit breaker housing. The terminals 3 and 4 are connected to conductors of this circuit.

In its normal position, the slider 10 is disposed as shown in FIGS. 1 and 2. In this case, the conductor 11 rests against the contacts 7 and 8 and serves as an intermediate contact assuring continuity of the electric circuit.

As will be apparent from FIG. 2, the vertical branch or arm of the conductor 11 rests against one side of the movable contact 7 and upon the fixed contact 8. An electric circuit is thus closed between the terminal 3, the bimetallic element 5, the movable contact 7, the intermediate contact 11, the fixed contact 8 and the terminal 4. The inclination of the ramp of the movable contact 7 engaged by the movable contact 11 is so selected that the spring 14 is unable to overcome the frictional resistance between the conductor 11 and the contact 7. The spring 14 is, in this position, compressed to the maximum.

In the event of a current flow in the circuit exceeding the rating of the circuit-breaker, the bimetallic element is deflected in the sense represented by the arrow 21, thereby withdrawing the movable contact 7 from the fixed contact 8. As the space between these contacts increases, the intermediate contact 11, connected to the slide 10, is displaced by the spring 14, in the direction of arrow 15 and mounts the inclined ramp formed by the movable contact 7 and is ultimately released thereby to permit the slide to pass to the right (FIG. 1).

The slide 10 ultimately comes to rest against the right hand wall of the housing with the conductor 11 spaced from the contacts 7 and 8 but, as shown in FIGS. 4 and 5, with the insulating tongue 13 interposed between the latter. This will also be apparent in FIG. 5 which although showing a different embodiment, represents the positions of the movable member and the parts carried thereby in the tripped position of the circuit breaker.

In the tripped position, there is no longer a conductive path between the movable contact 7 and the fixed contact 8 and the electric current 10 is open-circuited.

To reset the circuit breaker after tripping, it is merely necessary to displace the slide 10 to the left by engagement with the projection 18. The spring 14 is thereby compressed and the conductor 11 is lodged again behind the movable contact 7. Consequently, the movable contact acts as a detent for retaining the slide in its normal position. The tongue 13 is withdrawn from between the contacts 7 and 8 and the conductor 11 restores electrical connection between the two. The circuit is closed and the system ready for further operation.

For most effective functioning of the circuit breaker, it has been found to be advantageous to provide the intermediate contact with a slight transverse mobility which assures effective engagement of the conductor 11 with the fixed contact 8 and the movable contact 7 and hence a self-centering of the intermediate contact between them. This mobility can be obtained by permitting the movable contact 11 to rotate on the slide 10, to permit slight rotation of the slide 10 in the track 8, or to provide a slight transverse plane for the slider 10. This also ensures a self-centering of the insulating tongue 13 between the contacts 7 and 8. Since the ramp of the movable contact 7 forms a camming surface engaged by the conductor 11, it is pressed, not only against the contact 7, but also against the fixed contact 8.

FIGS. 4 and 5 illustrate a second embodiment of the invention in which the housing 1, 2 comprises, instead of the terminal 3, a mounting member 22 which carries a bimetallic element 5 but which does not project below the housing.

The bimetallic element 5 is wound with an insulating foil about which is coiled a resistance wire 24 serving as a heating element. One end of this resistance wire is connected to the movable contact 7 while the other end of the resistance wire is connected, via a conductor 25, to a brass terminal 26 independent of the mounting member 22 and projecting below the housing for connection in an electric circuit.

The second terminal 4, rigid with the fixed contact 8, and the slide with its conductive element 11 and its insulating tongue 13, are constituted as described in the first embodiment. Throughout the description and in the drawing, identical reference numerals are used to represent identical structures. In FIGS. 4 and 5, however, the adjusting element 16, serving as a seat for the spring 14, has been omitted although it may be provided in this embodiment as well.

In the closed position of the circuit, an electric current flow passes from the terminal 26 through the conductor 25, the wire 24, the movable contact 7, the intermediate contact 11, the fixed contact 8 and the terminal 4, the intermediate contact 11 serving to provide an electrical connection between the other contact 7 and 8 as described previously. Upon the development of an excessive current, the heat generated by the voltage drop through the resistance heating wire suffices to heat the bimetallic element and cause its deflection thereof with the ensuing release of the intermediate conductor 11 and the slider 10 in the manner previously described. Resetting of the circuit-breaker is effected by engagement with the projection 18 and the manual displacement of the slider to the left as shown in FIG. 4.

FIG. 6 is a transverse section of an embodiment of the invention, analogous to the view of FIG. 3 but simplified thereover such that elements disposed within the cavity 6 have not been shown. This embodiment is intended to be disposed flat upon the printed circuit, i.e. in a recumbent position, as opposed to the erect positions shown in FIGS. 1 through 3.

To this end, the housing is formed by two housing halves, 1 and 2, with the lower housing half 1 being formed with the mounting feet 19 and 20 adapted to rest upon the surface of the printed circuit. In this case, the upper housing half 2 is formed with the slot 17 traversed by the projection 18 rigid with the slider 10.

The terminals, such as the terminal 3 which has been shown, are bent at right angles so as to connect with conductive elements of the printed circuit in which the device can be included.

The internal construction and the functioning of the circuit breaker described is identical to one or the other of the embodiments previously described.

Figure 7:
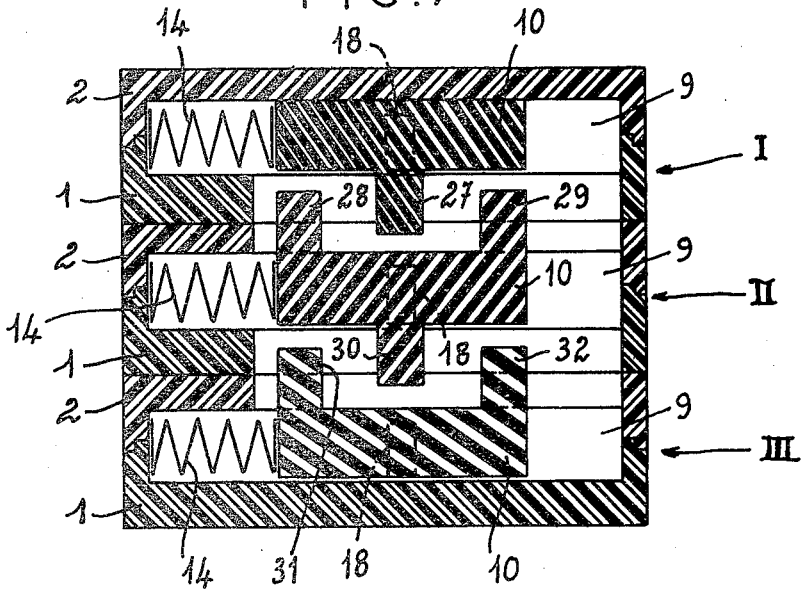
FIG. 7 is a cross-sectional view of still another modification of the apparatus for a multi-polar circuit.

FIG. 7 shows a multipolar embodiment of the invention and, more particularly, a tripolar version of the circuit-breaker assembly according to the invention. The parts which have previously been described with respect to the contacts, bimetallic element etc., have not been shown here. The assembly comprises three circuit-breakers, represented at I, II, and III and disposed in stacked relationship, each of the circuit-breakers having a respective housing consisting of two housing halves 1 and 2. The tracks 9 of each of the cirsuit-breakers have been illustrated and each receives a slider 10 biased by a spring 14, the sliders 10 being displaceable parallel to one another. Each comprises a conductive element and an insulating element, as described, cooperating with two contacts one of which is fixed while the other is movable and carried by the bimetallic element.

In addition to the projection 18, the slider 10 of the upper circuit-breaker I is formed at a central location with a finger 27 turned toward the slider 10 of the intermediate circuit breaker II. The latter is formed at its two ends with fingers 28 and 29, which are turned toward the slider 10 of the upper circuit breaker I and which receive the finger 27 between them with lost motion. In addition, the slider 10 of the intermediate circuit-breaker II, is formed with a third central finger 30 which engages between the upwardly turned fingers 31 and 32 of the slider 10 of the lower circuit breaker III. This latter circuit breaker has its slider 10, like the second circuit breaker, formed with a projection 18 which can be used for resetting.

The three sliders 10 are shown in their normal positions in which the respective contacts are closed and the respective intermediate contacts connect the movable and fixed contacts.

Upon the development of a high-intensity current exceeding the rating value in one of the three circuits, the tripping of the circuit-breaker, as described in connection with FIGS. 1 through 6, results in an engagement of one of the fingers of the tripped circuit breaker, with a finger of an adjacent circuit breaker to trip the latter and further causes the latter slider to trip the third circuit breaker.

If, for example, the excess current flow traverses the circuit of circuit-breaker I, the slider 10 thereof is shifted toward the right by its spring 14 and the finger 27 engages the finger 29 to draw the slider 10 of the circuit breaker II in this direction. The finger 30 then engages the finger 32 to draw the slider 10 of circuit breaker III to the right so that all of the circuits are tripped in cascade.

In an analogous manner, if the excessive current flow traverses the circuit of breaker II, the slider 10 of this circuit breaker is displaced by its spring 14 to the right so that finger 28 engages finger 27 while finger 30 engages finger 32 to trip the other breakers.

Circuit breaker II can be removed and circuit breakers I and III stacked so that a similar operation can be effected for a 2-pole system.

The circuit breaker according to the invention can be used in various applications as illustrated in the circuit diagrams of FIGS. 8 through 11 in which the device is represented very schematically. The reference numerals hitherto used for the structures of FIGS. 1 through 6 have been retained to designate the schematically illustrated structures in these figures. The detent means, constituted by the intermediate conductor 11 and the movable contact 7 with its ramps, is here represented by a ball detent at 33.

Figure 8:
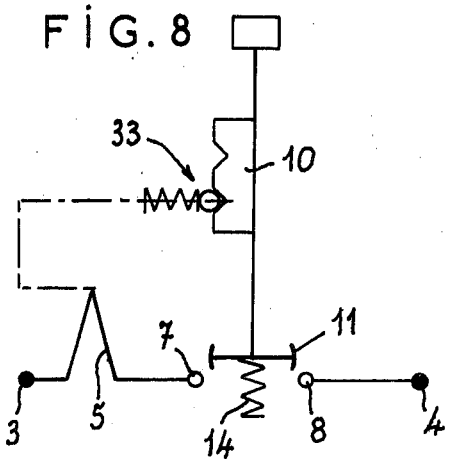
FIGS. 8 thru 11 are circuit diagrams illustrating various applications of the circuit breakers according to the invention.

FIG. 8 shows an application of the most simple type in which the bimetallic element 5 is heated directly, i.e. is included in series in the circuit to be protected between the terminals 3 and 4 and hence is traversed by the electric current whose intensity will trip the breaker. This embodiment, of course, corresponds to the embodiment previously described in connection with FIGS. 1–3.

Figure 9:
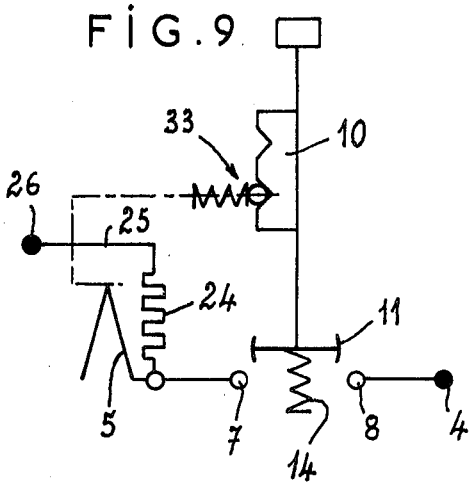

FIG. 9 shows still another elementary application wherein, however, the bimetallic element 5 is heated indirectly, i.e. is not connected in the circuit to be protected but is heated by the resistance heater 24 which is connected in the circuit to be protected between the movable contact 7 and the terminal 26 via the conductor 25. The second application corresponds to the embodiment illustrated in FIGS. 4 and 5.

Figure 10:
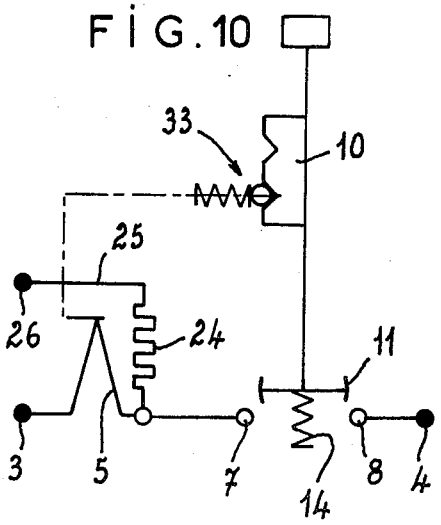

In FIG. 10, there is shown an application which constitutes a combination of the two embodiments in the sense that the bimetallic element 5 is heated in part directly and in part by the resistance heater 24. The same circuit breaker is thus able to protect a circuit in two ways and hence is a bicaliber circuit breaker.

Figure 11:
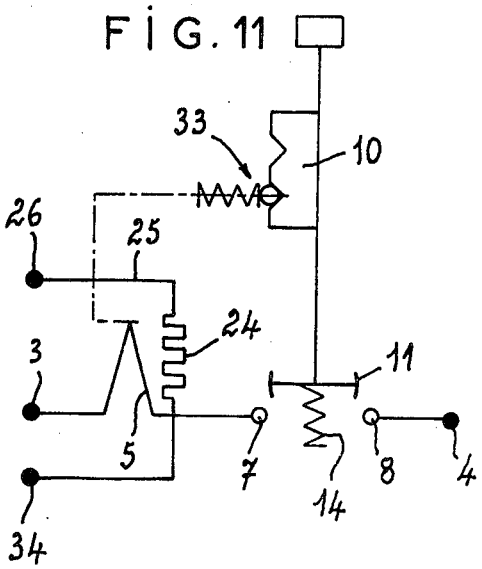

FIG. 11 shows yet another application of the circuit breaker according to the invention, in which the opening of the principal circuit to be protected is controlled by a separate command circuit. The principal circuit closes through the terminal 3, the bimetallic element 5, the movable contact 7, the intermediate contact 11, the fixed contact 8 and the second terminal 4. The command for operating auxiliary circuit is closed between the third terminal 26, the conductor 25, the resistance wire 24 and a fourth terminal 34.

Because of the various applications to which the circuit breaker can be put, it has been found to be advantageous to form the circuit breaker with a universal construction having four terminals and provided with both the directly heatable bimetallic element and the resistance heater for the bimetallic element.

The invention, as described, is susceptible to many applications within the spirit and scope of the appended claims and hence is not limited to the specific embodiments illustrated unless the claims are so limited.

I claim:

1. A miniature circuit breaker comprising:

a housing;

a fixed contact disposed in said housing;

a bimetallic element disposed in said housing and formed with a movable contact juxtaposed with said fixed contact;

a movable member in said housing displaceable between two positions corresponding respectively to closure of a circuit between said contacts and opening of said circuit;

a spring operatively connected to said member for shifting same between the first-mentioned and the second-mentioned positions;

a conductive element connected to said member and positioned to engage said contacts in said first position of said member;

and a blade-shaped insulating element on said member spaced from said element disposed so as to be positioned between said contacts in said second position of said member, said element engaging said movable contact so as to retain said member against displacement by said spring from said first position to said second position in the absence of deflection of said bimetallic element and to permit such displacement upon deflection of said bimetallic element in response to an excess current flow.

2. The circuit breaker defined in claim 1 wherein said movable contact has a triangular profile with two ramps inclined in opposite directions and engageable by said element.

3. The circuit breaker defined in claim 2 wherein the movable contact is a conical block on said bimetallic element.

4. The circuit breaker defined in claim 1 wherein said member is a slider and said housing has a track substantially parallel to said bimetallic element, said slider being shiftable along said track.

5. The circuit breaker defined in claim 4 wherein said conductive element is a wire bent at a right angle and having an arm seated in said slider and a further arm disposed between said contacts.

6. The circuit breaker defined in claim 5 wherein said conductive element has a circular cross-section.

7. The circuit breaker defined in claim 6 wherein said insulating element is a tongue integral with said slider.

8. The circuit breaker defined in claim 6 wherein said spring is a coil spring received under compression within said track.

9. The circuit breaker defined in claim 8 wherein said spring bears against said slider at one end and against said housing at an opposite end, said housing being formed with a plug closing said track at said other end.

10. The circuit breaker defined in claim 5 wherein said slider is formed with a projection accessible from the exterior of said housing and permitting manual displacement of said slider.

11. The circuit breaker defined in claim 1 wherein said housing is formed with a terminal connected to said bimetallic element whereby an electric current can be passed directly through said bimetallic element to heat the same.

12. The circuit breaker defined in claim 1, further comprising a resistance heating wire wound around said bimetallic element and connected at one end to a terminal formed in said housing and at an opposite end to said movable contact.

13. The circuit breaker defined in claim 1 for a multipolar circuit comprising an assembly of such housings each with a respective movable member, said housings being stacked and each of said members having fingers projecting toward the other member whereby displacement of one of said members entrains the other of said members to trip the circuits of both of the housings upon the tripping of the circuit of one of the housings.

14. The circuit breaker defined in claim 1 wherein said housing is formed of two housing halves defining an elongated cavity therebetween, said bimetallic element is elongated and is disposed in said cavity, said housing further having a track parallel to said elongated element, said member constituting a slider shiftable in said track parallel to said bimetallic element, said conductive element being a circular-cross-section wire bent at right angles and having a longitudinal arm received in said slider and a transverse arm projecting into said cavity between said contacts, said movable contact being conical, said spring being a compression spring disposed in said track parallel to said bimetallic element and bearing upon said slider, said insulating element being a tongue depending from said slider and integral therewith, said slider and said tongue being composed of synthetic resin material, said housing being formed with a slot, said slider having a projection extending through said slot and enabling manual resetting of said slider, said housing being formed with a plurality of terminals for connecting said contacts in an electrical circuit.

* * * * *